United States Patent [19]

Cronauer et al.

[11] 4,032,429

[45] June 28, 1977

[54] COAL LIQUEFACTION PROCESS USING AN ALUMINUM PHOSPHATE SUPPORTED CATALYST

[75] Inventors: Donald C. Cronauer, Gibsonia; William L. Kehl, Indiana Township, Allegheny County, both of Pa.

[73] Assignee: Gulf Research & Development Company, Pittsburgh, Pa.

[22] Filed: Nov. 28, 1975

[21] Appl. No.: 635,917

[52] U.S. Cl. ..... 208/10
[51] Int. Cl.[2] ..... C10G 1/08
[58] Field of Search ..... 208/10

[56] References Cited

UNITED STATES PATENTS

| | | | |
|---|---|---|---|
| 2,075,101 | 3/1937 | Dreyfus | 208/10 |
| 2,154,527 | 4/1939 | Dietz et al. | 208/10 |
| 2,347,231 | 4/1944 | Stoewener et al. | 208/10 |
| 2,377,728 | 6/1945 | Thomas | 208/10 |
| 3,271,299 | 9/1966 | Kearby | 208/216 |
| 3,594,305 | 7/1971 | Kirk | 208/10 |
| 3,904,550 | 9/1975 | Pine | 208/216 |

*Primary Examiner*—Delbert E. Gantz
*Assistant Examiner*—James W. Hellwege

[57] ABSTRACT

A process for the liquefaction of coal in the presence of hydrogen and a solid supported catalyst containing a hydrogenation component and wherein the support comprises an amorphous aluminum phosphate.

11 Claims, 1 Drawing Figure

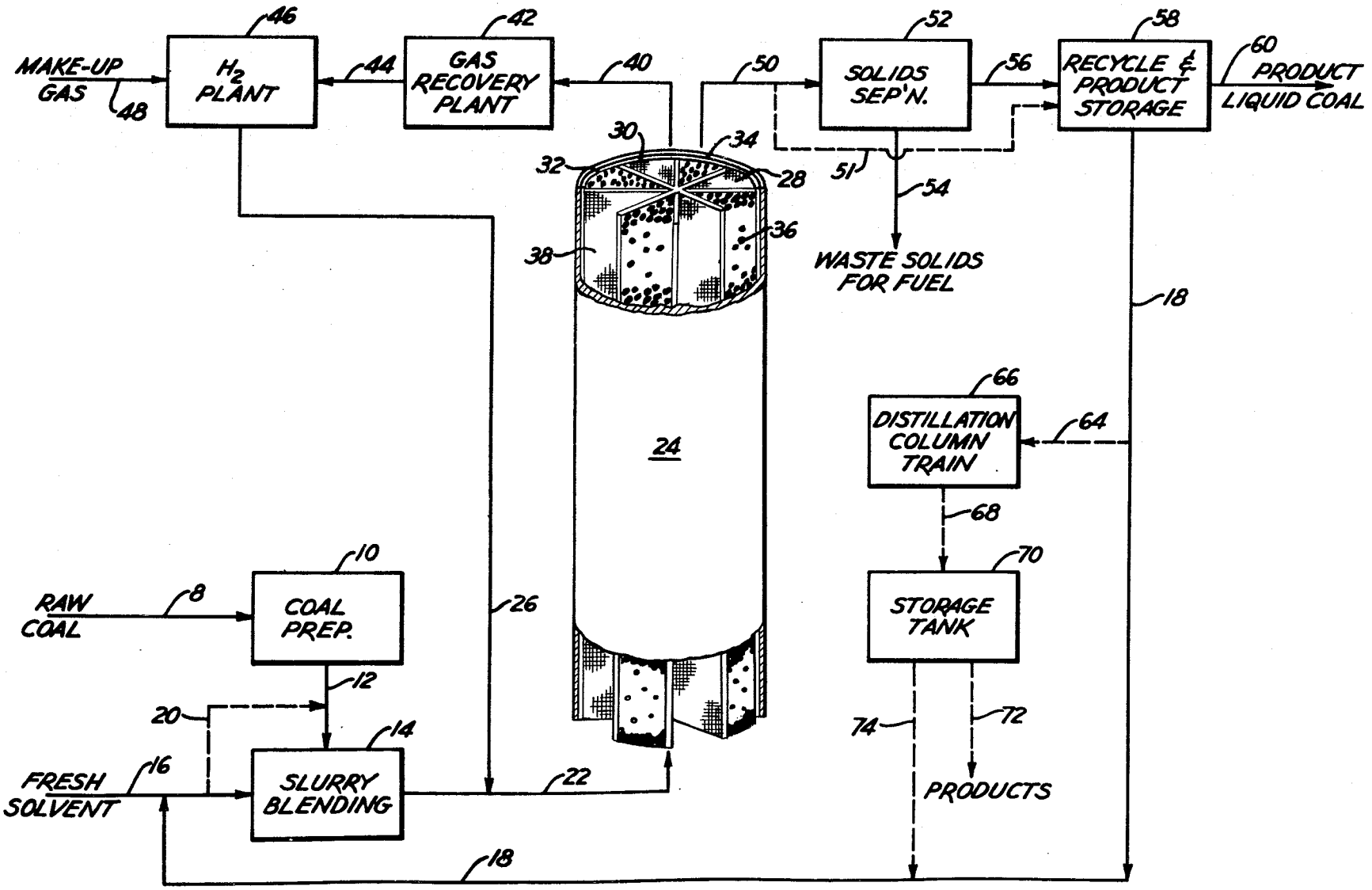
PRODUCT LIQUID COAL
60
RECYCLE & PRODUCT STORAGE
58
18
64
66
DISTILLATION COLUMN TRAIN
68
70
STORAGE TANK
72
PRODUCTS
74
52
SOLIDS SEP'N.
56
54
WASTE SOLIDS FOR FUEL
51
50
28
36
34
24
30
32
38
40
42
GAS RECOVERY PLANT
44
26
22
18
46
$H_2$ PLANT
10
COAL PREP.
12
14
SLURRY BLENDING
MAKE-UP GAS
48
8
RAW COAL
20
16
FRESH SOLVENT

COAL LIQUEFACTION PROCESS USING AN ALUMINUM PHOSPHATE SUPPORTED CATALYST

This invention relates to the use of an aluminum phosphate supported catalyst for the liquefaction of coal.

BACKGROUND OF THE INVENTION

The conversion of coal to liquid and gaseous fuel products is becoming of ever increasing importance in view of the vast reserves of coal in the world compared to the stores of liquid petroleum. Thermal techniques for the conversion of coal to liquid and ashless coal products is being studied, and proposals are under consideration for the catalytic conversion of coal to liquid type products. The catalytic conversion of coal, however, requires very rugged catalysts in view of the high ash, high sulfur and high metals content of the coal charge stocks. In addition, the liquefaction of coal tends to produce considerable amounts of coke, which normally weaken the catalyst physically during required regenerations of the catalyst to restore the activity of the catalyst to a reasonable level.

Research efforts have been directed, therefore, to the finding of a supported catalyst containing a hydrogenation component for use in the liquefaction of coal which possesses reduced coking tendencies and improved physical strength characteristics, especially after repeated regenerations to remove coke and/or metals deposits.

In accordance with the invention, an improved catalyst has been discovered for use in a process for the liquefaction of coal in a reaction zone in the presence of hydrogen under coal liquefaction conditions. The improved catalyst comprises a hydrogenation component distributed substantially uniformly on a support comprising an amorphous aluminum phosphate.

The solid carbonaceous materials that can be used herein can have the following composition on the moisture-free basis:

| | Weight Percent | |
|---|---|---|
| | Broad Range | Normal Range |
| Carbon | 45 – 95 | 60 – 92 |
| Hydrogen | 2.5 – 7.0 | 4.0 – 6.0 |
| Oxygen | 2.0 – 45 | 3.0 – 25 |
| Nitrogen | 0.75 – 2.5 | 0.75 – 2.5 |
| Sulfur | 0.3 – 10 | 0.5 – 6.0 |

The carbon hydrogen contents of the carbonaceous material will reside primarily in benzene compounds, multi-ring aromatic compounds, heterocyclic compounds, etc. Oxygen and nitrogen are believed to be present primarily in chemical combination with the aromatic compounds. Some of the sulfur is believed to be present in chemical combination with the aromatic compounds and some in chemical combination with inorganic elements associated therewith, for example, iron and calcium.

In addition to the above, the solid carbonaceous material being treated herein may also contain solid, primarily inorganic, compounds which will not be convertible to liquid product herein, which are termed as "ash", and are composed chiefly of compounds of silicon, aluminum, iron and calcium, with smaller amounts of compounds of magnesium, titanium, sodium and potassium. The ash content of a carbonaceous material treated herein will amount to less than 50 weight percent, based on the weight of the moisture-free carbonaceous material, but in general will amount to about 0.1 to about 30 weight percent, usually about 0.5 to about 20 weight percent.

Anthracitic, bituminous and subbituminous coal, lignitic materials, and other types of coal products referred to in ASTM D-388 are exemplary of the solid carbonaceous materials which can be treated in accordance with the process of the present invention to produce upgraded products therefrom. When a raw coal is employed in the process of the invention, most efficient results are obtained when the coal has a dry fixed carbon content which does not exceed 86 percent and a dry volatile matter content of at least 14 percent by weight as determined on an ash-free basis. The coal, prior to use in the process of the invention, is preferably ground in a suitable attrition machine, such as a hammermill, to a size such that at least 50 percent of the coal will pass through a 40-mesh (U.S. Series) sieve. The ground coal is then dissolved or slurried in a suitable solvent. If desired, the solid carbonaceous material can be treated, prior to reaction herein, using any conventional means known in the art, to remove therefrom any materials forming a part thereof that will not be converted to liquid herein under the conditions of reaction.

Any liquid compound, or mixtures of such compounds, having hydrogen transfer properties can be used as solvent herein. However, liquid aromatic hydrocarbons are preferred. By "hydrogen transfer properties" we mean that such compound can, under the conditions of reaction herein, absorb or otherwise take on hydrogen and also release the same. A solvent found particularly useful as a startup solvent is anthracene oil defined in Chamber's Technical Dictionary, MacMillan, Great Britan 1943, page 40, as follows: 37 A coal-tar fraction boiling above 518° F. [270° C.], consisting of anthracene, phenanthrene, chrysene, carbazole and other hydrocarbon oils." Other solvents which can be satisfactorily employed are those which are commonly used in the Pott-Broche process. Examples of these are polynuclear aromatic hydrocarbons such as naphthalene and chrysene and their hydrogenated products such as tetralin (tetrahydronaphthalene), decalin, etc., or one or more of the foregoing in admixture with a phenolic compound such as phenol or cresol.

The selection of a specific solvent when the process of the present invention is initiated is not critical since a liquid fraction which is obtained during the defined conversion process serves as a particularly good solvent for the solid carbonaceous material. The liquid fraction which is useful as a solvent for the solid carbonaceous material, particularly coal, and which is formed during the process, is produced in a quantity which is more than sufficient to replace any solvent that is converted to other products or which is lost during the process. Thus, a portion of the liquid product which is formed in the process of the invention advantageously recycled to the beginning of the process. It will be recognized that as the process continues, the solvent used initially becomes increasingly diluted with recycle solvent until the solvent used initially is no longer distinguishable from the recycle solvent. If the process is operated in a semicontinuous basis, the solvent which is employed at the beginning of each new period may be that which has been obtained from a previous operation. For example, liquids produced from coal in accordance with the present invention are aromatic and generally have a boiling range of about 300° to about 1400° F. (149° to 760° C.), a density of about 0.9 to about 1.1, and a carbon to hydrogen mole ratio in the range of about 1.3:1 to about 0.66:1. A solvent oil obtained from a subbituminous coal, such as Wyoming-Montana coal, comprises a middle oil having a typical boiling range of about 375° to about 675° F. (191° to about 357° C.). Thus, the solvent that is employed herein can broadly be defined as that obtained from a previous conversion of a carbonaceous solid material in accordance with the process defined herein. Although the term "solvent" is used, it is understood that such term covers the liquid wherein the liquid product obtained herein is dissolved as well as the liquid in which the solid materials are dispersed.

The ratio of solvent to solid carbonaceous material can be varied so long as a sufficient amount of solvent is employed to effect dissolution of substantially all of the solid carbonaceous material in the reaction vessel. While the weight ratio of solvent to solid carbonaceous material can be within the range of about 0:6:1 to about 4:1, a range of about 1:1 to about 3:1 is preferred. Best results are obtained when the weight ratio of solvent to solid carbonaceous material is about 2:1. Ratios of solvent to solid carbonaceous material greater than about 4:1 can be used but provide little significant functional advantage in dissolving or slurrying the solid cabonaceous material for use in the process of this invention. An excessive amount of solvent is undesirable in that added energy or work is required for subsequent separation of the solvent from the system.

The catalyst for use in the process of this invention comprises a support material and a hydrogenation component substantially uniformly distributed over the surface of the support material. The hydrogenation component can be any hydrogenation catalyst well known to those having ordinary skill in the art, but preferably the hydrogenation component comprises at least one hydrogenating component selected from the group consisting of metals, metal oxides and/or metal sulfides of Groups VI and/or VIII of the periodic table. More preferably the hydrogenation component comprises at least one hydrogenating component selected from the group consisting of the metals, metal sulfides and/ or metal oxides of (a) a combination of about 2 to about 25 percent (preferably about 4 to about 16 percent) by weight molybdenum and at least two iron group metals where the iron group metals are present in such amounts that the atomic ratio of each iron group metal with respect to molybdenum is less than about 0.4 and (b) a combination of about 5 to about 40 percent (preferably about 10 to about 25 percent) by weight of nickel and tungsten where the atomic ratio of tungsten to nickel is about 1:0.1 to 5 (preferably about 1:0.3 to about 4 ), said hydrogenating component being composited with a porous support. Particularly preferred among the hydrogenating metals are nickel, cobalt, molybdenum and tungsten. Catalysts of type "(a)" may contain molybdenum in the amount conventionally used, i.e., about 2 to about 25 percent molybdenum based on the total weight of the catalyst including the porous carrier. Smaller amounts of molybdenum than about 2 percent may be used, but this reduces the activity. Larger amounts than about 25 percent can also be used but do not increase the activity and constitute an extra expense. It is preferred to utilize a catalyst containing about 4 to about 16 percent by weight molybdenum, most preferably about 10 percent; about 2 to about 10 percent by weight nickel, most preferably about 2 percent; and about 1 to about 5 percent by weight cobalt, most preferably about 1.5 percent. While a three-metal component catalyst as in "(a)" is preferred, a two-metal component catalyst as in "(b)" can also be used. When using a two-metal component catalyst, it is preferred to utilize one containing about 15 to about 25 percent (e.g., about 19 percent) tungsten and about 2 to about 10 percent (e.g., about 6 percent) nickel supported on a porous carrier such as alumina. In a two-metal component catalyst, the weight ratio of tungsten to nickel is preferably in the range of about 2:1 to about 4:1 tungsten to nickel, respectively. The amounts of the iron group metals in "(a)" and "(b)" may be varied as long as the above proportions are used. However, in "(a)" it is preferred to utilize one iron group metal in an atomic ratio between about 0.1 and about 0.2 and to use the other iron group metal or metals in an atomic ratio of iron group metal to molybdenum of less than about 0.1 and especially between about 0.05 and about 0.1. All of the iron group metals may be present but it is preferred to use only two. The amount of hydrogenating component based on the metal itself can suitably be from about 0.5 to about 60 percent by weight of the catalyst including the porous carrier, but is usually within the range of about 2 to about 30 percent by weight of the catalyst including the carrier.

The above-mentioned active hydrogenating components can also be present as mixtures. One the other hand, chemical combinations of the iron group metal oxides or sulfides with the molybdenum oxide and/or sulfide can be utilized.

The catalytic hydrogenation components discussed above either singly or in combination, are deposited substantially uniformly on a support comprising amorphous aluminum phosphate. The amorphous aluminum phosphate can be used alone. Preferably the aluminum phosphate is an amorphous coprecipitate containing aluminum, phosphorus and oxygen; and while these elements are chemically, combined their precise chemical connection is not certain. X-ray diffraction patterns indicate that the aluminum phosphate material is amorphous. While the aluminum phosphate can be used alone, an amorphous coprecipitate containing excess aluminum, as the oxide, can also be used. Usually the atomic ratio of aluminum to phosphorus in the preferred supports is in the range of about 11:1 to 1:1 and is preferably in the range of 5:1 to 1:1.

Amorphous precipitates of aluminum phosphate are known in the art. These precipitates are prepared by neutralization of a strongly acidic aqueous medium containing aluminum cations and $PO_4^{---}$ anions in a substantially equal molar ratio. Such acidic solutions are prepared by dissolving in water a highly soluble aluminum salt and a source of $PO_4^{---}$ ions, usually ortho-phosphoric acid. The aluminum salt employed is not critical, provided only that it does not contain an anion which will form a precipitate in the subsequent precipitation step. Aluminum nitrate and aluminum halides, particularly aluminum chloride, are the aluminum salts of choice for use in the invention. While certain phosphate salts such as triammonium orthophosphate can be used as the source of the $PO_4^{---}$ ions, ortho-phosphoric acid is the source of choice for providing the $PO_4^{---}$ ions.

The amorphous aluminum phosphate precipitate is prepared by neutralizing the acidic medium containing aluminum cations and phosphate anions. When the pH is increased to 6 or higher, the aluminum and phosphorus moieties precipitate from the aqueous medium. While in theory the neutralization can be carried out by mixing the acidic solution with an appropriate alkali in any manner, it is preferred to simultaneously add the acidic medium and the neutralizing alkali to a stirred aqueous medium. The two solutions should be added at controlled rates so that the pH is continuously maintained at a preselected pH in the range of about 6.0 – 10.0. While a wide variety of bases can be used to neutralize the acidic medium, it is preferred to use ammonium hydroxide or an ammonium salt such as ammonium carbonate so that the aluminum-phosphorus precipitate will be free of metallic ions that might be incorporated into the precipitate, if inorganic bases such as sodium carbonate or sodium hydroxide were used in the process. While the precipitation reaction can be carried out over a wide range of temperatures, ambient temperature usually is employed, as no significant advantages are obtained by heating or cooling.

After the precipitation is completed, the precipitate is filtered, washed one or more times to free the precipitate of occluded ions, and dried. Thereafter, the precipitate is calcined in a conventional manner at a suitable temperature, typically in a range of about 125°–500° C. No advantages are obtained by calcining at higher temperatures, and it is preferred to avoid calcining the product at temperatures above about 1100° C., as some crystallization takes place at these higher temperatures. A product calcined for 4 hours at 1100° C. appeared to be crystalline and to have a rudimentary tridymite-type structure.

The calcined aluminum phosphate product is amorphous, typically has a bulk density in the range of about 0.25 to 0.5 grams/cm$^3$, and typically has the appearance of a compacted mass of spherical granules having a diameter on the 100–500micron range.

As noted above, the support for the catalyst of this invention can also be an amorphous coprecipitate containing aluminum and phosphorus moieties in which the aluminum and phosphorus are present in an atomic ratio within the range previously described.

The aluminum-phosphorus containing coprecipitates are prepared by the same procedures employed to prepare the aluminum phosphate precipitate, except that the molar ratio of aluminum cations to $PO_4^{---}$ anions is adjusted to a range from about 11:1 to above 1:1, and preferably a range of 5:1 to above 1:1 and more preferably to a range about 3.5:1 to about 1.2:1.

As certain aluminum salts, ortho-phosphoric acid and ammonium hydroxide are soluble in certain polar solvents such as methanol, it is possible to prepare the previously described inorganic carriers by carrying out the indicated synthesis steps in such polar solvents or in mixtures of water and such polar solvents.

In addition, the catalyst supports or carriers can contain other materials such as alumina and silica. It has been found that the addition of a separate silica-alumina aids in the pelleting of the aluminum phosphate compositions described above. The silica content of the added silica-alumina can suitably be from 50 to 90 weight percent of the silica-alumina. The silica-alumina added can suitably be present in an amount from 10 to 30 weight percent of the composite catalyst.

The formation of the composite catalysts, i.e. the hydrogentation component plus the support comprising aluminum phosphate, can occur by any method which is well known in the art, and such methods do not per se form a part of the present invention. Such methods include, for example, the deposition of one or more salts of hydrogenation metals onto the preformed support by a suitable technique such as the technique of minimum excess solution (incipient wetness). Other suitable techniques are described, for example, in U.S. Pat. No. 2,880,177, which issued to R. A. Flinn and J. B. McKinley on Mar. 31, 1959.

The catalysts can be formed into any suitable size for use in fluid bed, ebullating bed or fixed-bed operation, and preferably a fixed-bed operation is employed. In a fixed-bed operation, the particle size of the composited catalyst can suitably be from 1/32 inch diameter to ¼ inch diameter extrudate, or about 1/32 to ¼ inch diameter spheroids.

When treating a carbonaceous material, such as a coal slurry, according to the process of the invention, it is customary to continue the reaction until the catalyst activity has decreased markedly due to the deposition of ash and/or coke or other carbonaceous material thereon. In the process of the present invention, the reaction will continue over an extended period of time before regeneration of the catalyst is required. When regeneration of the catalyst becomes necessary, the catalyst can be regenerated by combustion, i.e., by contact with an oxygen-containing gas such as air at an elevated temperature, usually about 900° F. (482° C.), or by any other means normally used to regenerate hydrogenation catalysts. The manner in which the catalyst is regenerated does not constitute a portion of the present invention. It is one of the advantages of the catalysts for use in the process of this invention that they retain their physical strength characteristics after repeated oxidative burn-off regenerations and, in fact, surprisingly, appear to increase in strength after an oxidative burn-off regeneration.

The process of the invention will be more readily understood by referring to the FIGURE, which is a schematic flow diagram of one embodiment of the invention showing a preferred form of a multi-partitioned reaction vessel wherein the cross-sectional segments of the vertical reaction zones are sectors. While the process described in the Figure is with reference to the treatment of raw coal, it is to be understood that any solid carbonaceous material, as defined herein, having a tendency to form coke and/or ash during conversion can suitably be treated by the process of this invention. Coal is simply exemplary of the carbonaceous materials which can be treated in the process of the invention.

Referring now to the Figure, a carbonaceous solid material, such as raw coal, is introduced into coal preparation unit 10 through line 8. In coal preparation unit 10, the coal is ground by a suitable attrition machine such as a hammermill to a size, for example, such that 50 percent of the coal will pass through a 100 mesh sieve (U.S. Series). Ground coal particles are transferred from coal preparation unit 10 through line 12 into a slurry blending unit 14 where the coal is mixed with a solvent in a weight ratio of solvent to coal of about 1:1 to about 3:1. When the process is initiated, fresh solvent, such as anthracene oil, is introduced into slurry blending unit 14 through line 16. As the process continues, a sufficient amount of solvent oil is produced so that fresh solvent is gradually replaced by recycle solvent oil which is introduced into slurry blending unit 14 through line 18. If desired, all or a portion of the solvent can be passed through line 20 to line 12 to aid in transferring ground coal to slurry blending unit 14. A slurry of coal particles and solvent is removed from slurry blending unit 14 through line 22, where it is mixed with high pressure hydrogen supplied through line 26. The mixture of coal, oil and hydrogen is then inroduced into the bottom of reaction vessel 24. If desired, the oil-coal mixture in line 22 may be preheated by any suitable heat exchange means (not shown) prior to being introduced into reaction vessel 24. While the mixture of coal, solvent and hydrogen is shown as being introduced into the bottom of reaction vessel 24 for upflow operation, the mixture can be introduced into the top of reaction vessel 24 for downflow operation. Preferably, however, the mixture of coal, solvent and hydrogen is introduced into the bottom of reaction vessel 24 and passed upflow through reaction vessel 24 in a flooded-bed type reaction system. While the hydrogen is shown as being introduced together with the coal and solvent into the bottom of reaction vessel 24, the hydrogen can be introduced at multiple places through the reaction vessel. Similarly some of the coal and/or solvent can be introduced at multiple places throughout the reactor.

The hydrogen is introduced into reaction vessel 24 in amounts between about 2000 and about 20,000 standard cubic feet of hydrogen per barrel of coal slurry. The hydrogen gas stream is preferably at least about 60 percent hydrogen, the remainder of the gas stream being gases such as nitrogen, carbon monoxide, carbon dioxide and/or low molecular weight hydrocarbons, such as methane. The exact reaction conditions in reaction vessel 24 depend upon a number of factors, for example, the amount of liquefaction desired, but, in general, include temperatures of 500° to 900° F. (260° to 482° C.), usually temperatures between about 750° and about 875° F. (399° and about 474° C.), and pressures of about 500 to about 10,000 psig, usually pressures between about 1500 and 4000 psig. The weight hourly space velocity of the coal slurry is suitably from about 0.25 to about 40, usually about 0.5 to about 20 unit weight of charge stock per unit weight of catalyst per hour. The catalyst can be any hydrogenation catalyst as defined hereinabove, but is preferably a three-metal component catalyst comprising molybdenum, nickel and cobalt supported on a carrier comprising amorphous aluminum phosphate. The particle size of the catalyst will depend upon the size of the reaction vessel and upon the size of the openings in the porous partitions of the reaction vessel. The particles of catalyst are sufficiently large so that they do not pass through the openings in the porous partitions.

Reaction vessel 24 may contain one segmented basket 28 or it may contain a number of such baskets stacked on top of each other so that the unobstructed passageways 30 and the catalyst-containing segments 32, in this embodiment, are in direct line through the reaction vessel. Basket 28 is in cylindrical shape, the outer surface 34 of which may be solid, but is preferably provided with openings large enough to permit the transfer of reactants (including coal fines) and products therethrough while retaining the catalyst particles 36 therein. The inner walls 38 of the partitions separating the catalyst segments from the unobstructed passageways are provided with openings large enough to permit the transfer of reactants (including coal fines) and products therethrough while not allowing catalyst particles to pass from the catalyst segments. In the Figure the cross-sectional configuration of the segments in basket 28 are sectors, but other configurations such as cylindrical tubes can suitably be employed.

Gases from reaction vessel 24 are removed through line 40 to a gas recovery plant 42. Gas recovery plant 42 comprises any suitable means for separating gases from liquids. The gases separated in gas recovery plant 42 are passed through line 44 to a hydrogen plant 46 where hydrogen is recovered and any low molecular weight hydrocarbon gases are converted to hydrogen. Depending upon economic considerations, the low molecular weight hydrocarbon gases can be sold and hydrogen generated by other satisfactory means, such as gasification of coal, or a product stream containing undesirable materials, such as high-boiling tars or waste solids, can be used as a hydrogen source. Hydrogen is then returned through line 26 to reaction vessel 24. Any makeup gas which is needed to supply hydrogen for the hydrogen plant is added through line 48. Liquid products containing some solid materials are removed from reaction vessel 24 through line 50 into a solids separation unit 52. If desired, solids separation unit 52 can be bypassed, for example, when substantially no solid materials are in the liquefied product, in which case the liquid products removed from reaction vessel 24 can be passed directly by line 51 to a product storage and recycle unit 58. Solids separation unit 52 comprises any suitable means for separating solids from liquids such as a continuous rotating filter, centrifuge, or liquid cyclone. Solid materials are removed from the separation unit 52 through line 54. If the solid materials removed by line 54 contain some of the original carbonaceous materials, as in the case wherein it is desired not to solubilize all of the original carbonaceous material, and solid inorganic material, the two can be separated from each other by any means convenient in the art. The solid carbonaceous material will be upgraded, for example, be lower in sulfur content than the original charge, and can be used as fuel. The liquid product is removed from separation unit 52 through line 56 to product storage and recycle unit 58, from which liquid product can be removed through line 60. A portion of the liquid product is recycled as solvent through line 18 and returned to a slurry blending unit 14. Optionally, the liquid product from storage and recycle unit 58 can be sent through line 64 to a distillation column train 66 where various cuts can be removed at a desired pressure, usually under vacuum for the recovery of specific distillation cuts which can then be passed through line 68 to a storage tank farm 70. The various products can then be removed through line 72. In this manner specific solvent cuts can be removed and recycled as solvent through line 74 to slurry blending unit 14. It is believed obvious to those having ordinary skill in this art that by varying the reaction conditions in reaction vessel 24, but within the range of conditions set forth above, more or less hydrocracking can occur, which would give more or less liquefied product and/or more or less lighter boiling products for distillation in distillation column train 66. It is also within the purview of the disclosure herein that product in line 50 containing solids be sent directly to a distillation column train wherein the component parts thereof can be separated into selected fractions.

DESCRIPTION OF THE PREFERRED EMBODIMENTS

CATALYST PREPARATION

EXAMPLE 1

1500 grams of $Al(NO_3)_3—9H_2O$ were dissolved in 10 liters of distilled water, and 230 grams of $H_3PO_4$ (85 wt % $H_3PO_4$ ) were stirred into the aluminum nitrate solution. A stirring medium was prepared by adding 1500 cc of water to a mixing vessel, and a few drops of dilute $NH_4OH$ were added to adjust the pH to 8.0. The solution $Al(NO_3)_3—9H_2O$ and $H_3PO_4$ was added slowly to the mixing vessel, with stirring, and $NH_4OH$ solution was added simultaneously in a separate stream at a rate which maintained the pH = 8.0. A white precipitate was formed under these conditions. After all of the aluminum nitrate - phosphoric acid solution was added, the precipitate slurry was stirred for approximately 10 minutes, and filtered. The filter cake was washed on the filter with 6 liters of distilled water, and then dried at 248° F . (120° C.) in air for 16 hours. The proportions of aluminum nitrate and phosphoric acid used correspond to a composition of 0.33 $Al_2O_3$–0.67 $AlPO_4$ (mole fractions for this calcined precipitate after the calcination. X-ray diffraction indicated that the precipitate was amorphous both in oven-dried state and after calcination.

EXAMPLE 2

The amorphous aluminum-phosphorous coprecipitate shown in Example 1 was used as the support for the preparation of a nickel-tungsten catalyst wherein the amount of nickel and the amount of tungsten were 6 and 19 weight percent metal, respectively. The nickel and tungsten were deposited onto the aluminum-phosphorus coprecipitates by the method of incipient wetness using the proper volume of an aqueous solution of nickel nitrate and ammonium meta-tungstate. The product was dried at 250° F. (121° C.) and the dried product was ground to a fine powder, mixed with a lubricant (polyvinylchloride and Acrowax) and formed into 3/16- inch diameter pellets. The pellets were calcined in air at 1000° F. (538°C.) for 10 hours.

EXAMPLE 3

Example 2 was repeated except before pelleting, the sample was blended with about 20 weight percent of a 75% silica- 25% alumina powder (AAA purchased from American Cyanamid) to aid in the formation of the pellets.

EXAMPLE 4

A tri-metal hydrogenation catalyst was also prepared using as support the coprecipitated aluminum-phosphorus composition shown in Example 1 above. This catalyst contained 0.5% nickel, 1% cobalt and 8% molybdenum by weight and was prepared by the following procedure:

1. the catalyst support was calcined at 1000° F. (538° C.) for 10 hours;
2. the 8% molybdenum was added as a water solution of $NH_4$ para-molybdate by the incipient wetness method;
3. the solid of (2) was dried at 250° F. (121° C);
4. the Co and Ni was added as a water solution of the nitrate to the solid (3), again the incipient wetness; and
5. the solid (4) was dried at 250° F. (121° C) then calcined at 1000° F. (538° C.) for 10 hours.

The catalyst was ground to a fine powder and blended with 20 weight percent of a silica-alumina composition containing 75 weight percent silica to assist in the formation of ⅛-inch diameter pellets which were then calcined at 1000° F. (538° C.) for 10 hours.

EXAMPLE 5

For comparison purposes, a Filtrol commercial catalyst based on gamma-alumina was selected. This catalyst contained 0.5% nickel, 1% cobalt and 8% molybdenum, which were added to the gamma-alumina by impregnation.

A first series of runs was made in a unit similar to unit 24 described in connection with the Figure. The reactor contained four compartments, and each compartment consisted of two vertically stacked baskets designed to hold catalyst particles. Since the object of the runs was to compare coke and metals deposition plus the physical characteristics of the catalyst after regeneration, in some runs differing amounts of various catalysts were employed but maintained separate by the use of the various baskets. In the experiments below, the weight of catalyst is given in grams, and this weight was distributed in one of the eight baskets. By operating in this manner, several different catalysts could be tested simultaneously under substantially identical environmental conditions.

The feed, unless otherwise indicated, consisted of a 30/70 blend of as-received Big Horn subbituminous coal with anthracene oil. The characteristics of Big Horn and other coals used in the experiments are given in the following Table:

Coal Analysis of Various Coals Used in the Experiments

| Coal | Montana | Big Horn (Wyoming) | Pitt (Seam) |
|---|---|---|---|
| Analysis (Moisture-free basis) | | | |
| Carbon | 67.14 | 69.34 | 78.68 |
| Hydrogen | 4.81 | 4.60 | 4.96 |
| Nitrogen | 0.93 | 1.23 | 1.57 |
| Oxygen (difference) | 19.55 | 19.90 | 6.27 |
| Sulfur | 0.37 | 0.54 | 1.65 |
| Ash | 7.20 | 4.39 | 6.87 |
| | 100.00 | 100.00 | 100.00 |
| Moisture | 25.8 | 22.0 | 2.5 |
| Rank | Sub-bituminous | Sub-bituminous | Bituminous |

The reaction conditions were varied after each 15-hour period of operation to study the effect of differing levels of severity. The product slurry was filtered, washed with ethyl acetate, and dried. The percent solution was calculated on a moisture- and ash-free basis (MAF) using the following equation:

% solvation = (MAF coal feed − MAF filter solids)-/MAF coal feed × 100

To obtain a measure of the hydrocracking of the MAF coal to distillate liquid and gases, a sample of filtrate was distilled to measure the residue remaining at conditions of 750° F. (400° C.) pot temperature at 3 mm Hg. pressure. The percent hydrocracking was then calculated as follows:

% hydrocracking = (MAF coal feed −MAF filter solids − residue)/MAF coal feed × 100

The results of the first series of runs are set forth on Table I below. The purpose of these runs was to determine the overall level of activity of the various catalyst for coal liquefaction.

TABLE I

SUMMARY OF COAL LIQUEFACTION RUNS

| Catalyst | NiCoMo on $Al_2O_3$ from Ex. 5 | | | (A) (B) | 410.9 g of Catalyst from Ex. 4 ($NiCoMo$ on $Al_2O_3$-$AlPO_4$) 198.1 g of Catalyst from Ex. 5 | | | Regenerated Catalyst from Exs. 9–12 | |
|---|---|---|---|---|---|---|---|---|---|
| Example No. | 6 | 7 | 8 | 9 | 10 | 11 | 12 | 13 | 14 |
| Reaction Conditions | | | | | | | | | |
| Temperature ° F. | 800 | 750 | 800 | 800 | 750 | 800 | 800 | 800 | 750 |
| Temperature (° C.) | (427) | (399) | (427) | (427) | (399) | (427) | (427) | (427) | (399) |
| Slurry Feed Rate (lb/hr) | 7.6 | 7.1 | 2.9 | 7.1 | 6.7 | 1.8 | 7.1 | 6.6 | 7.0 |
| WHSV (No. coal/hr/No. cat) | 1.40 | 1.11 | 0.32 | 1.59 | 1.50 | 0.41 | 1.60 | 1.31 | 1.39 |
| Result Summary | | | | | | | | | |
| % Solvation | 91 | 74 | 100 | 92 | 75 | 99 | 89 | 89 | 75 |
| % Hydrocracking | 72 | 46 | 91 | 78 | 47 | 76* | 68 | 68 | 46 |
| Filtrate Analysis | | | | | | | | | |
| Viscosity (Cs at 210° F.) | 2.11 | 2.38 | 1.41 | 2.19 | 3.09 | 1.61 | 2.58 | 2.26 | 3.22 |
| Hydrogen (wt %) | 8.22 | 7.87 | 9.82 | 7.96 | 7.45 | 9.18 | 7.65 | 8.05 | 7.57 |
| Nitrogen | 0.41 | 0.45 | 0.15 | 0.38 | 0.47 | 0.18 | 0.54 | 0.47 | 0.60 |
| Oxygen | 0.75 | 0.98 | 0.27 | 0.90 | 1.40 | 0.56 | 1.20 | 0.94 | 1.30 |
| Sulfur | <0.05 | <0.04 | <0.04 | 0.05 | 0.10 | 0.06 | 0.07 | 0.05 | <0.04 |

*This value seems low considering comparable runs and Example 9 results.

Referring to Table 1 above, a comparison of Examples 6–8 (the standard alumina-based catalyst) with the remaining Examples shows the presence of substantial amounts of catalysts supported on amorphous aluminum phosphate substantially affect the percent solvation or the percent hydrocracking at similar operating conditions. Example 13 and 14 show the catalyst can be successfully regenerated from an acitivity standpoint.

The carbon content of the used catalysts from Examples 12 and 14 are shown in Table 2.

TABLE 2

| Ex. No. | Used Catalyst from Ex. No. | Catalyst | Carbon (wt %) |
|---|---|---|---|
| 15 | 12 | $NiCoMo$ on $Al_2O_3$-$AlPO_4$ (Ex. 4 catalyst) | 10.83 |
| 16 | 12 | $NiCoMo$ on $Al_2O_3$ (Ex. 5 catalyst) | 17.47 |
| 17 | 14 | $NiCoMo$ on $Al_2O_3$-$AlPO_4$ (Ex. 4 catalyst) | 20.79 |
| 18 | 14 | $NiCoMo$ on $Al_2O_3$ (Ex. 5 catalyst) | 27.55 |

Referring to Table 2, the NiCoMo catalyst on the amorphous coprecipitated aluminum phosphate support is markedly superior to the NiCoMo on alumina catalyst with respect to the amount of carbon deposited on the catalyst during the run.

The crush strength characteristics of the phosphorus-containing supports used to make the catalysts of this invention are also superior as shown by the data in Table 3 below. The crush strength of the coked catalyst from Example 12 was determined, and then the catalyst was regenerated by calcining in air for 16 hours at 1000° F. (538° C.) Similarly, crush strengths for the coked and regenerated forms of the catalyst from Example 14 were determined. It should be noted that Examples 9, 10, 11 and 12 were a series of runs without regeneration or replacement of the catalyst in between the runs. The catalyst from Example 12 was then regenerated as noted and used in Examples 15 and 16.

TABLE 3

I. Crush strength data for catalysts from Example 5 used in Examples 9 through 14.

| Crush Strength No./sq. inch | Fresh Cat. from Ex. 5 | Coked Ex. 5 Catalyst after Ex. 12 | Regen. Cat. from Ex. 12 | Coked Ex. 5 Cat. after Ex. 14 | Regen. Cat. from Ex. 14 |
|---|---|---|---|---|---|
| Maximum | 30.1 | 17.1 | 17.9 | 14.1 | 13.5 |
| Maximum 10% | 26.6 | 15.0 | 15.9 | 12.2 | 12.4 |
| Average | 20.6 | 9.9 | 8.6 | 6.9 | 6.4 |
| Minimum 10% | 13.4 | 5.3 | 4.6 | 3.2 | 3.1 |
| Minimum | 12.1 | 3.9 | 3.3 | 2.6 | 2.2 |

II. Crush strength data for catalyst from Example 4 used in Examples 9 through 14

| Crush Strength No./sq. inch | Fresh Cat. from Ex. 4 | Coked Ex. 4 Catalyst after Ex. 12 | Regen. Cat. from Ex. 12 | Coked Ex. 4 Catalyst after Ex. 14 | Regen. Cat. from Ex. 14 |
|---|---|---|---|---|---|
| Maximum | 17.1 | 19.0 | 24.8 | 22.8 | 16.1 |
| Maximum 10% | 15.6 | 17.9 | 21.5 | 18.9 | 15.7 |
| Average | 9.9 | 12.8 | 14.4 | 13.8 | 10.5 |
| Minimum 10% | 5.9 | 7.0 | 6.5 | 6.5 | 4.8 |

TABLE 3-continued

| | | | | | |
|---|---|---|---|---|---|
| Minimum | 5.6 | 5.9 | 4.6 | 5.0 | 2.7 |

Referring to Table 3 above, it can be seen that the amorphous aluminum phosphate supported catalysts of this invention retained their strength much better than the alumina supported catalysts.

The crush strength and catalytic activity of the coal solvation catalysts of this invention before and after repeated regenerations was also investigated using a batch autoclave system rather than the continuous unit described above.

In the Examples to follow, the following procedure was employed:

1. From 10 to 30 grams of catalyst were mixed with 450 grams of anthracene oil and 225 grams of subbituminous coal from Montana in a 2-liter autoclave;

2. the autoclave was heated with rocking to an operating temperature of 800° F. (427° C.) and the pressure was increased to 3500 psig (24.1 MPa) wih hydrogen. Heat-up time was about 3 hours.

3. The reactor was controlled at 800 ° F. (427° C.) for 2 hours and make-up hydrogen was fed every 15 minutes to bring the pressure to 3500 psig (24.1 MPa).

4. The reactor was then cooled (about 2 hours).

5. The slurry was removed and filtered; the filter cake was washed with ethyl acetate and dried.

6. The catalyst was separated from the filter cake for further treatment.

The catalyst from each run was regenerated by calcining in air at 1000° (538° C .). Samples of catalyst were then submitted for determination of side crush strength. The remaining regenerated catalyst was used in the follow-up runs.

The results of a series of runs using two different lots of a catalyst are shown in Table 4 below:

TABLE 4

CATALYST CRUSH STRENGTH
Batch Autoclave Runs[2] Using Montana Coal

| Catalyst | NiCoMo on Alumina 1/8 " extrudates | | | | NiCoMo on Alumina 3/16" extrudates | | | NiCoMo on 0.33 $Al_2O_3$-0.67 $AlPO_4$ + 20 After % AAA - 3/16" pellets | | | |
|---|---|---|---|---|---|---|---|---|---|---|---|
| Ex. No. | 19 | | | | 20 | | | 21 | | | |
| Crush Strength (Lb.) | Fresh | A | B | C[1] | Fresh | A | B | Fresh | A | B | C |
| Maximum | 30.1 | 14.5 | 10.9 | — | 36.5 | 8.5 | Powder | 30.7 | 13.1 | 20.6 | 23.8 |
| Maximum 20% | 26.6 | 11.8 | 9.2 | — | 32.3 | 5.7 | Powder | 18.4 | 12.1 | 17.1 | — |
| Average | 20.6 | 7.4 | 3.7 | — | 20.4 | 2.0 | Powder | 11.9 | 9.1 | 9.7 | 14.9 |
| Minimum 20% | 13.4 | 4.6 | 0 | — | 10.7 | 0 | Powder | 7.8 | 7.6 | 5.4 | — |
| Minimum | 12.1 | 3.3 | 0 | — | 5.6 | 0 | Powder | 6.3 | 4.2 | 3.2 | 3.5 |

[1]Insufficient full size pellets remaining for testing.
[2]Run Conditions: 800° F. (427° C.); 3500 psig; 2 hrs. at temperature for each cycle.
A - after one cycle of use and regeneration.
B - After two cycles of use and regeneration.
C - After three cycles of use and regeneration.

Referring to Table 4, Examples 19 and 20 show significant decreases in catalyst side crush strength on regeneration. In these Examples, an alumina support was employed. Example 21 shows that the presence of phosphorus in the support results in the average crush strength actually increasing as the regenerations increase, which substantially confirms the results found in the continuous runs discussed above, A series of batch autoclave runs was made using the catalyst of Example 2 and a catalyst consisting of 6% nickel and 19% tungsten on an alumina support. The purpose of this series of runs was to demonstrate that the presence of the silica-alumina binder in the catalyst for Example 21 is not required for maintaining the crush strength of the catalysts of this invention. The procedure was the same as for the Examples shown on Table 4, and the crush strengths are shown in Table 5.

TABLE 5

| Ex. No. | 22 | | | 23 | | |
|---|---|---|---|---|---|---|
| Catalyst | Ni-W on 0.33 $Al_2O_3$-0.67 $AlPO_4$ (Catalyst of Ex. 2) | | | Ni-W on $Al_2O_3$ | | |
| Crush Strength (lb) | Fresh | Coked | Regen. | Fresh | Coked | Regen |
| Average | 5.3 | 6.8 | 7.7 | 26.1 | 13.6 | 14.6 |

Referring to Table 5, the crush strength of the $AlPO_4$ containing catalyst (Ex. 22) increased after regeneration, while with the alumina based catalyst (Ex. 23), the crush strength decreased.

A final series of runs was made to determine the effect of the A1:P ratio in the supported catalyst on the coking properties of the catalyst. Three additional alumina-aluminum phosphate catalysts containing 6 weight percent nickel and 19 weight percent tungsten were prepared according to the procedures in Examples 1 and 2, except the A1:P ratios were 0.14 $A1_2O_3$:0.86 $A1PO_4$, 0.56 $A1_2O_3$:0.44 $A1PO_4$, and 0.82 $A1_1O_3$:0.18 $A1PO_4$. These three catalysts, having different A1:P ratios, were evaluated in a coal liquefaction run as in Examples 9 to 12 above using Pitt seam coal. All of the samples were loaded into the reactor in separate baskets in a unit similar to unit 24 described in connected with the Figure. Since all the samples were placed in the reactor and subjected to the same charge stock and the same reaction conditions, an assumption may be made that they are identical runs except for the amount of catalyst used. At the conclusion of the run, a 30-gram sample of each catalyst was regenerated by heating in a stream of air at 1000° F. (538° C.) overnight, and the weight loss during regeneration was noted. The coking data is presented in Table 6 as weight percent loss on regeneration and shows that in pellets formed wihout the addition of AAA binder, the weight percent loss on regeneration increases with increasing $Al_2O_3$ content.

TABLE 6

Effect of Al:P Ratio on Coking Property of Catalysts

| Ex. No. | Description of Catalyst | Al:P | Coking (Wt % Loss on Regeneration) |
|---|---|---|---|
| 24 | 6 wt% Ni - 19 wt% W on 0.14 $Al_2O_3$ - 0.86 $AlPO_4$ w/o AAA | 1.3:1 | 14.69 |
| 25 | 6 wt% Ni - 19 wt% W on 0.33 $Al_2O_3$ - 0.67 $AlPO_4$ w/o AAA | 2:1 | 13.47 |
| 26 | 6 wt% Ni - 19 wt% W on 0.56 $Al_2O_3$ - 0.44 $AlPO_4$ w/o AAA | 3:1 | 17.4 |
| 27 | 6 wt% Ni - 19 wt% W on 0.82 $Al_2O_3$ - 0.18 $AlPO_4$ w/o AAA | 11:1 | 25.53 |

Resort may be had to such variations and modifications as fall within the spirit of the invention and the scope of the appended claims.

We claim:

1. In a process for the liquefaction of coal in a reaction zone in the presence of a solvent having hydrogen transfer properties and hydrogen and solid supported catalyst containing a hydrogenation component under coal liquefaction conditions, the improvement which comprises utilizing a catalyst support comprising an amorphous aluminum phosphate.

2. In a process for the liquefaction of coal in a reaction zone in the presence of a solvent having hydrogen transfer properties and hydrogen and a solid supported catalyst containing a hydrogenation component under coal liquefaction conditions, the improvement which comprises utilizing a catalyst support comprising a material selected from the group consisting of:

a. an amorphous precipitate of aluminum phosphate;

b. an amorphous coprecipitate containing aluminum and phosphate moieties in an atomic ratio of greater than 1:1 and c. mixtures of (a) and (b).

3. A process in accordance with claim 2 wherein the catalyst support comprises an amorphous coprecipitate containing aluminum and phosphorus moieties and wherein the atomic ratio of aluminum to phosphorus is greater than 1:1.

4. A process in accordance with claim 3 wherein the aluminum to phosphorus atomic ratio is from about 1:1 to 5:1.

5. A process in accordance with claim 4 wherein the support contains, in addition, a pelletizing agent.

6. A process acccording to claim 5 where the pelletizing agent is a silica-alumina and is used in an amount from 10 to 30 weight percent of the final catalyst.

7. A process in accordance with claim 4 wherein the hydrogenation component is at least one metal, metal oxide or metal sulfide from Groups VI and VIII of the Periodic Table.

8. A process for the conversion of solid carbonaceous materials containing less than about 50 weight percent of solid inorganic compounds which tend to produce coke during conversion which comprises.

contacting a slurry composed of said solid carbonaceous material and a solvent having hydrogen transfer properties and hydrogen in a reaction zone with a solid supported catalyst containing a hydrogenation component, under hydrogenation conditions and wherein said support for said catalyst comprises a material selected from the group consisting of:

a. an amorphous precipitate of aluminum phosphate;

b. an amorphous coprecipitate containing aluminum and phosphorus moieties in an atomic ratio of greater than 1:1 to 11:1 and c. mixtures of (a) and (b);

continuing said contacting until said catalyst requires regeneration to restore the activity of the catalyst to a desired level;

regenerating said catalyst;

and recontacting said regenerated catalyst in said reaction zone with said slurry.

9. A process according to claim 8 wherein the solid carbonaceous material is a bituminous, subbituminous or lignite coal; the catalyst support has an aluminum to phosphorus atomic ratio of about 2:1 and the hydrogenation component is at least one metal, metal oxide or metal sulfide of Groups VI and/or VIII of the Periodic Table.

10. A process in accordance with claim 9 wherein said regeneration is of the oxidative burn-off type.

11. A process in accordance with claim 9 wherein the hydrogenation conditions include a temperature between 500° and about 900° F., a slurry weight hourly space velocity from 0.25 to about 50, and a reaction pressure from 500 to about 10,000 pounds per square inch.

* * * * *

UNITED STATES PATENT OFFICE
CERTIFICATE OF CORRECTION

Patent No. 4,032,429 Dated June 28, 1977

Inventor(s) Donald C. Cronauer and William L. Kehl

It is certified that error appears in the above-identified patent and that said Letters Patent are hereby corrected as shown below:

Col. 2, line 38 - "37" should be deleted and a quotation mark inserted.
Col. 3, line 23 - "0:6:1" should be --0.6:1--.

Col. 10, lines 57 & 58 - The formula should read:

$$-- \% \text{ solvation} = \frac{\text{MAF coal feed} - \text{MAF filter solids}}{\text{MAF coal feed}} \times 100 --$$

Col. 10, lines 66 & 67 - The formula should read:

$$-- \% \text{ solvation} = \frac{\text{MAF coal feed} - \text{MAF filter solids} - \text{residue}}{\text{MAF coal feed}} \times 100 --$$

Cols. 11 & 12, Table 1, under "Reaction Conditions", "No.coal/hr/No.cat)" should read --(Lb.coal/hr/Lb.cat)--.
Col. 11, Table 2, about line 47 - Across from Ex. 18 under "Catalyst), "NiCoMo on $Al_2O_3$" should read --NiCoMo on $Al_2O_3$ (Ex. 5 Cat.)--.

Col. 12, lines 1-3 - Delete "TABLE 2-continued" and the headings following.
Col. 12, line 28 - Delete "(Ex. 5 catalyst)".
Col. 12, Table 3, parts I and II, the headings "Crush Strength No./sq.inch" should read --Crush Strength Lb./sq.inch--.
Col. 14, line 39 - "$Al_1O_3$:0.18 $AlPO_4$" should read --$Al_2O_3$:0.18 $AlPO_4$--.

Signed and Sealed this

Fourth Day of April 1978

[SEAL]

Attest:

RUTH C. MASON
Attesting Officer

LUTRELLE F. PARKER
Acting Commissioner of Patents and Trademarks